US005673754A

United States Patent [19]

Taylor, Jr.

[11] Patent Number: 5,673,754

[45] Date of Patent: Oct. 7, 1997

[54] METHOD AND APPARATUS FOR DOWNHOLE FISHING OPERATIONS

[76] Inventor: William T. Taylor, Jr., 1412 Cottage Dr., Houma, La. 70360

[21] Appl. No.: 490,052

[22] Filed: Jun. 13, 1995

[51] Int. Cl.[6] ..... E21B 31/00

[52] U.S. Cl. ..... 166/301; 166/98

[58] Field of Search ..... 166/98, 301, 178; 175/299; 294/86.25

[56] References Cited

U.S. PATENT DOCUMENTS

| | | | |
|---|---|---|---|
| 2,377,249 | 5/1945 | Lawrence | 166/98 |
| 2,734,581 | 2/1956 | Bonner | 166/98 |
| 2,762,438 | 9/1956 | Naylor | 166/301 |
| 2,829,716 | 4/1958 | Stewart | 166/98 |
| 3,472,326 | 10/1969 | Sutliff et al. | 175/321 X |
| 3,539,026 | 11/1970 | Sutliff et al. | 175/299 |
| 4,844,157 | 7/1989 | Taylor | 166/178 |
| 4,846,273 | 7/1989 | Anderson et al. | 166/178 |
| 5,029,642 | 7/1991 | Crawford | 166/72 |
| 5,139,086 | 8/1992 | Griffith, Sr. | 166/178 |
| 5,228,507 | 7/1993 | Obrejanu et al. | 166/98 |

*Primary Examiner*—Hoang C. Dang
*Attorney, Agent, or Firm*—Roy, Kiesel & Tucker

[57] ABSTRACT

An accumulator insertable into a well fishing string for delivering upward forces to stuck objects in a well having a cased portion. The accumulator has a housing with a top and a bottom, the top and bottom being attachable to a fishing string. A slippage member is positioned on the housing for engaging the cased portion of the well so that when so engaged, the accumulator is supportively connected to the cased portion against downward movement but the accumulator can move upwardly in the well. An activator connected to the slippage member is provided for engaging the slippage member against the wellbore.

15 Claims, 6 Drawing Sheets

METHOD AND APPARATUS FOR DOWNHOLE FISHING OPERATIONS

FIELD OF INVENTION

This invention relates to tools for recovering stuck objects in a well bore, and more particularly, to tools for retaining tensile force on a stuck object in a well bore to assist in recovering that stuck object.

BACKGROUND OF THE INVENTION

The subject of this application is a downhole fishing tool and a method for use of same with optional fishing string elements and arrangements. Stuck equipment in a wellbore (commonly referred to as "fish" or a "stuck fish") (including stuck pipe) is one of the most time consuming and expensive things that can go wrong in working a well. Drilling or workover operations must come to a halt while the fish is recovered, and if recovery is not possible, the hole must be sidetracked around the fish or the hole may be abandoned. Efficient recovery of fish is thus important.

A fish can be any undesirable object in the hole that must be removed by a special operation before work on the well can continue, such as the loss of a wire line logging tool, a bit cone, hand tools, a part of the drill suing, or even naturally occurring pieces of iron pyrite. To remove a fish from the hole, specialized equipment ("fishing tools") and procedures must be used. A fishing tool can be a threaded pipe, a mill, a piloted mill, a wall hook, or most commonly an overshot (e.g. Taylor, U.S. Pat. No. 5,085,479) as well as other tools capable of attaching to a fish. The fishing tool is usually connected with other equipment to create a fishing string. A jar is usually included in the fishing string above the fishing tool for applying upward (an up jar) or downward (a down jar) forces to the fish, or a two-way jar (an up and down jar) (e.g. Taylor, U.S. Pat. No. 4,333,542; Buck, U.S. Pat. No. 4,889,198). Often, a jar accelerator, a device for increasing the jarring force imparted by a jar, is mounted above the jar (Taylor, U.S. Pat. No. 4,844,157; Anderson; U.S. Pat. No. 4,846,273). A conventional fishing string is usually assembled in the following manner (from the top down): accelerator, drill collars or weight bars, jar, fishing bumper jar, and fishing tool. Pipe can also be included in the fishing string. When fish recovery fails, the use of other remedial tools such as mills and wash-over pipes are accepted by the industry.

The fishing string is lowered and raised in the hole via a working string. This working string can be wireline, coil tubing, or drill pipe. If the fish is loose in the hole, i.e., not stuck, it will move upward relatively easily. If the fish is stuck, a higher amount of force will be required to free it before it can be removed from the hole. Typically, when the fish is stuck in the hole, the working string will consist of drill pipe as neither coil tubing or wireline is capable of sustaining substantial tensile loads.

When force is applied to a stuck fish, it can react in various ways. The fish might come free, or it may move a short distance and then stop, requiring further fishing operations. Alternatively, the fish may fail to move as the energy imparted is insufficient to free the fish. If the fish is a fairly long section of stuck pipe, the stuck pipe may stretch for a distance before releasing. If there is a problem such as a cave-in of the hole, a higher amount of force will be required to remove the fish through a relatively long vertical distance.

One of the common problems encountered when fishing is the inability to maintain and increase the tensile load on the overshot or fishing tool while jarring and/or pulling the fish out of the hole. That is, when jarring energy is expended on the fish, if the fish did not release, the application of energy will result in an upward movement of the fishing string, generally through the stretching of the components. If this upward motion is not "captured," the fishing string will return to its initial position and the application of energy substantially wasted.

Another problem encountered is that the jarring energy imparted by a jar can be inefficiently spent by jarring the working string instead of the stuck fish.

Another problem is that the maximum mount of force that can be applied to the fish is limited to the yield strength of the working string and the fishing string. Normally, the fishing string can take a much higher load than the working string.

Another problem is the inability to accumulate the energy delivered by the jars to the fish.

Another problem is that previous attempts to solve these types of problems have limited vertical distances through which they can operate, limited to the length of some internal part of the device.

SUMMARY OF THE INVENTION

The tool functions to assist in removal of a fish by storing and accumulating the jarring energy as a tensile force on the fish. When an upward force is delivered to an overshot or other fishing tool attached to a fish, the energy imparted by the upward force is converted into a tensile load on the fishing string as the string stretches upward in response to the upward impact. The present tool prevents the loss of the imparted energy by preventing the stretched string from rebounding. The tool thus captures and maintains the energy as a tensile load. Subsequent upward forces will act additively to the existing tensile load, and further upward movement is again captured. Thus, the tensile load on the stuck object increases until the fish releases or the tool fails.

Accordingly, the invention disclosed herein has a tubular housing, having axial slots, the bottom of the housing connected to a fishing tool. The top of the housing is a collapsible cone, and slidable on the exterior of that cone is a slip having serrated or wickered edges. Slidable in the interior of the housing is a spring loaded cam actuator having a cam pin. The cam pin cooperates with a rotatable cam sleeve to move cam actuator axially in housing. The slip is fixed to the cam actuator by bolts slidable in housing axial slots. Extending from the top of the housing is a tubular anvil, where top of the tubular anvil is connectable to a fishing string.

Anvil is slidable in housing interior. As the anvil moves downward engaging the cam actuator, the cam actuator cooperates with the rotatable cam to move the cam actuator, and the attached slip, upward. The slip then slides up the exterior of the collapsible cone and are forced radially outward into the casing of the wellbore, where the serrated edges of the slips grip the casing to prevent downward movement.

OBJECTS OF INVENTION

An object of the present invention is to maintain a tensile load on the fishing tool after fishing operations begin.

Another object of the present invention is to allow the application of force to the fish in excess of the tensile strength of the working string.

Another object of the present invention is to allow the fishing tool to be anchored against downward motion through any vertical distance without having to release and reset the fishing string.

Another object of the present invention is to provide an accumulator which may be used in all downhole fishing operations, using various working strings, including wire line, coil tubing, snubbing, work over figs, etc.

Another object of the present invention is to provide a relatively easy, safe, and economical method for utilizing an energy accumulator for fishing purposes in as part of an overall fishing string containing elements in combination with the accumulator.

DETAILED DESCRIPTION OF THE INVENTION

Turning to the drawings, FIGS. 1A through 1D show the invention in its "caught" position, while FIGS. 2A through 2D show the invention in its "released" position. "Released" indicates that the invention, if inserted in a wellbore, would be free to move upward or downward within the wellbore while "caught" indicates the invention could only move upward in the well bore.

Figure 1A:
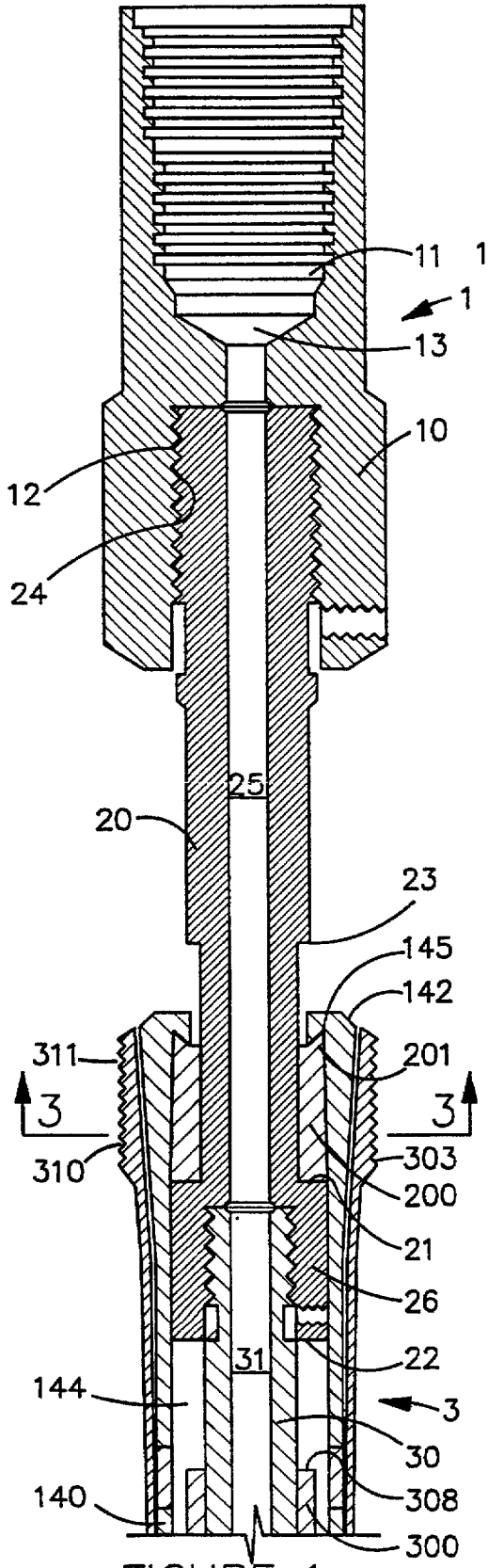
FIG. 1A through 1D is a longitudinal cross section of the present invention in the catch position.
Figure 1B:
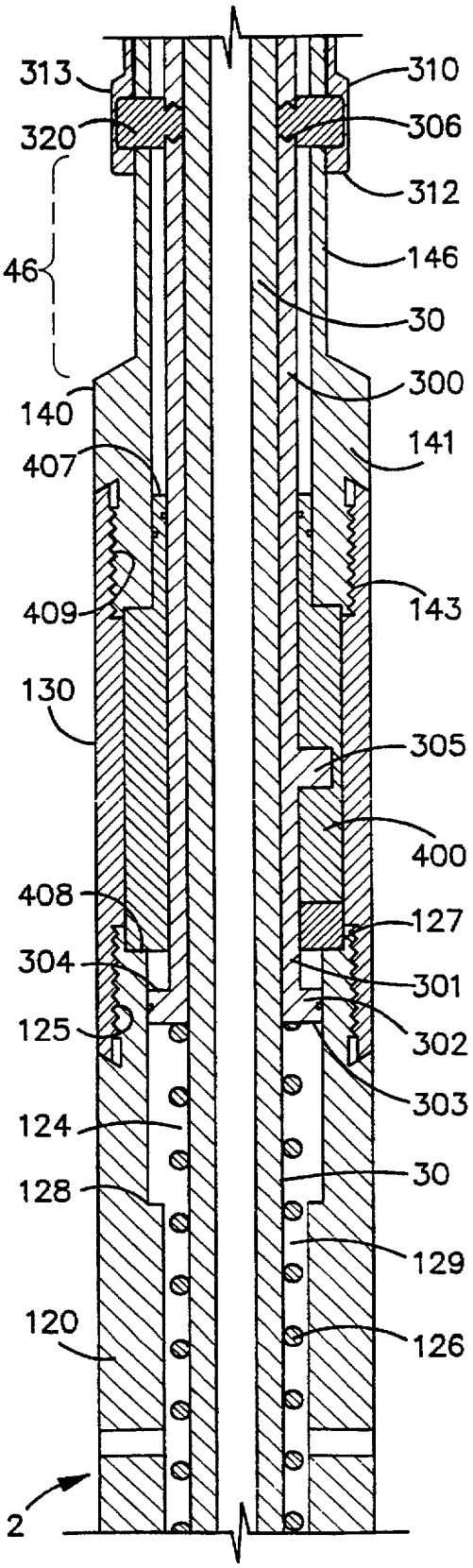
Figure 1C:
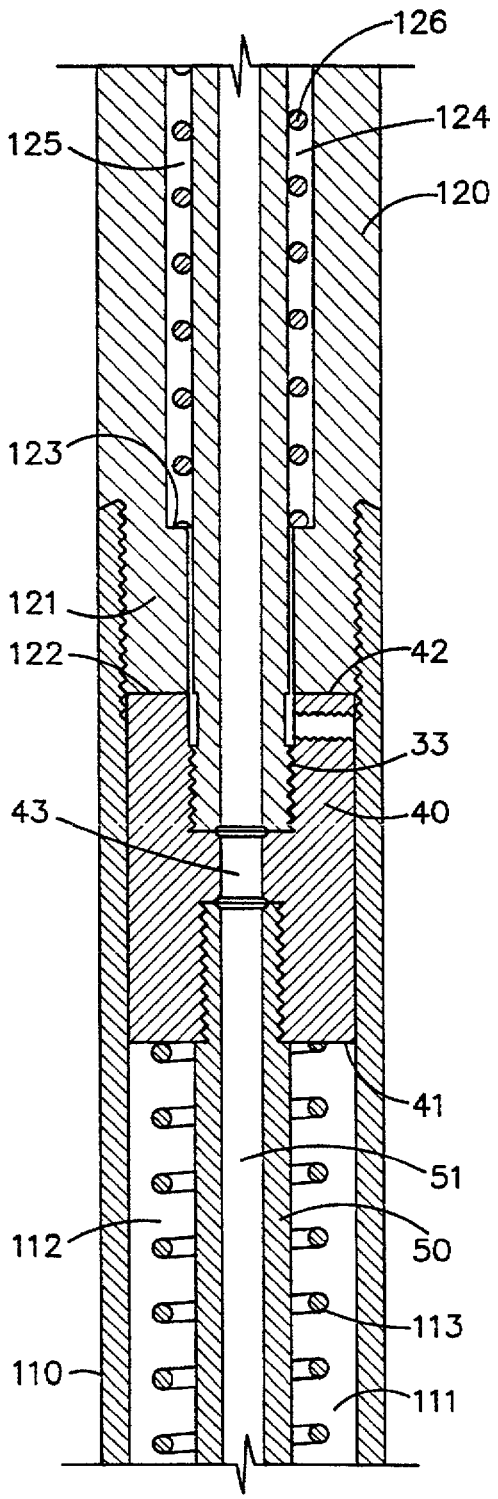
Figure 1D:
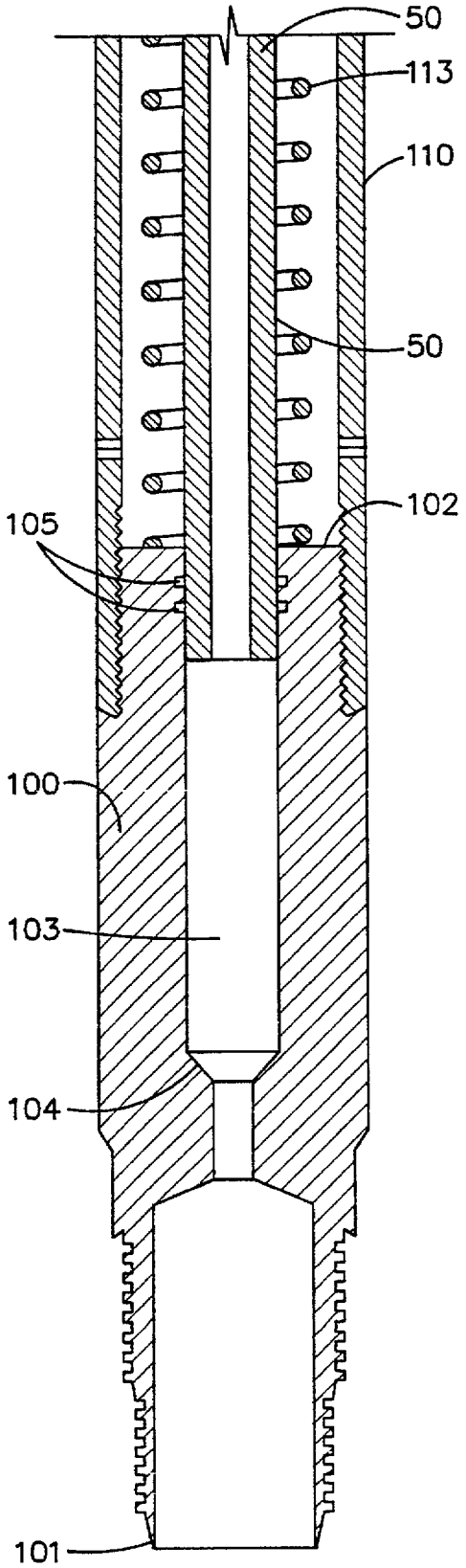
Figure 2A:
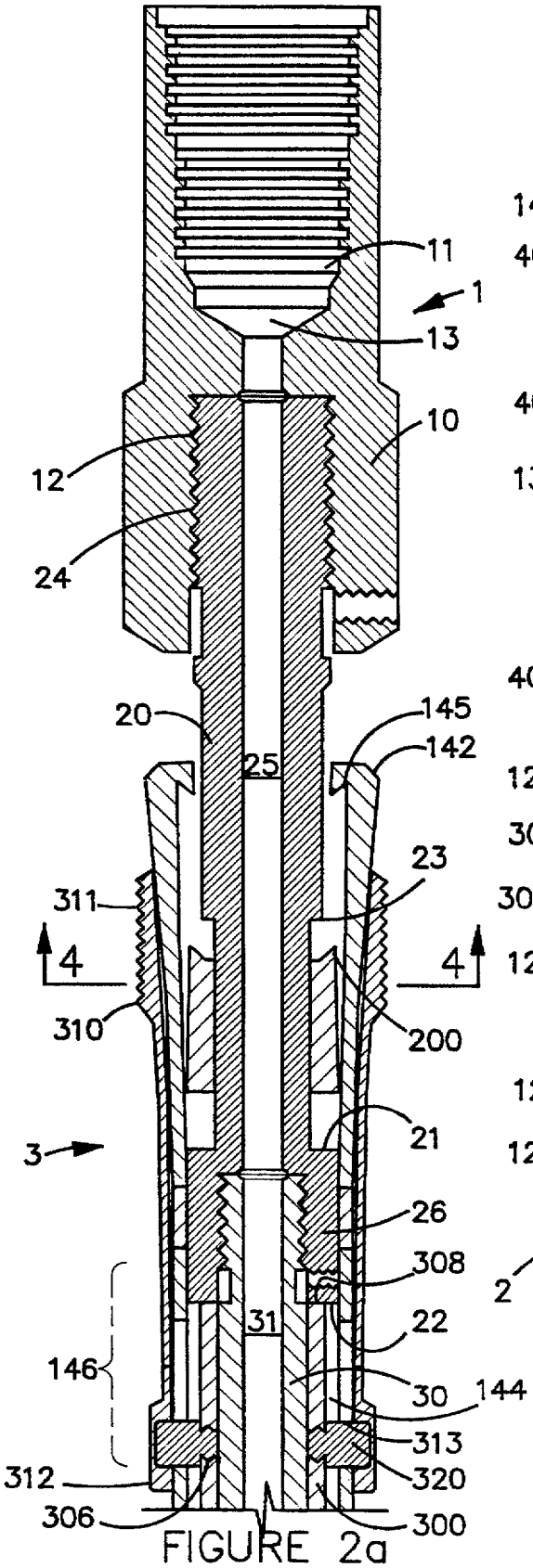
FIG. 2A through 2D is a longitudinal cross section of the present invention in the release position.
Figure 2B:
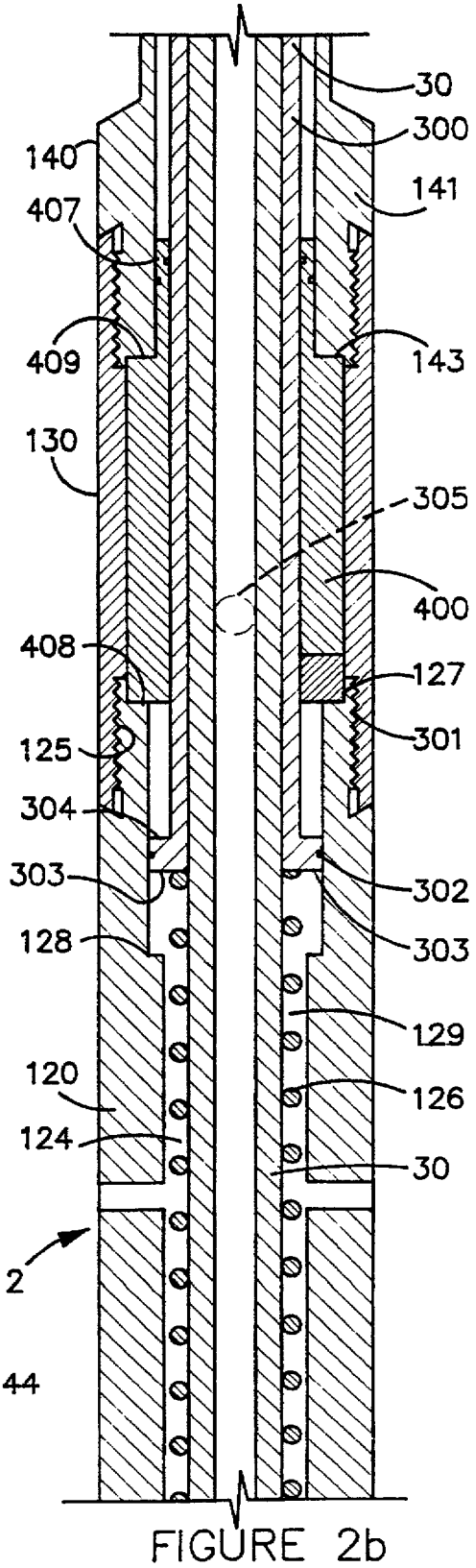
Figure 2C:
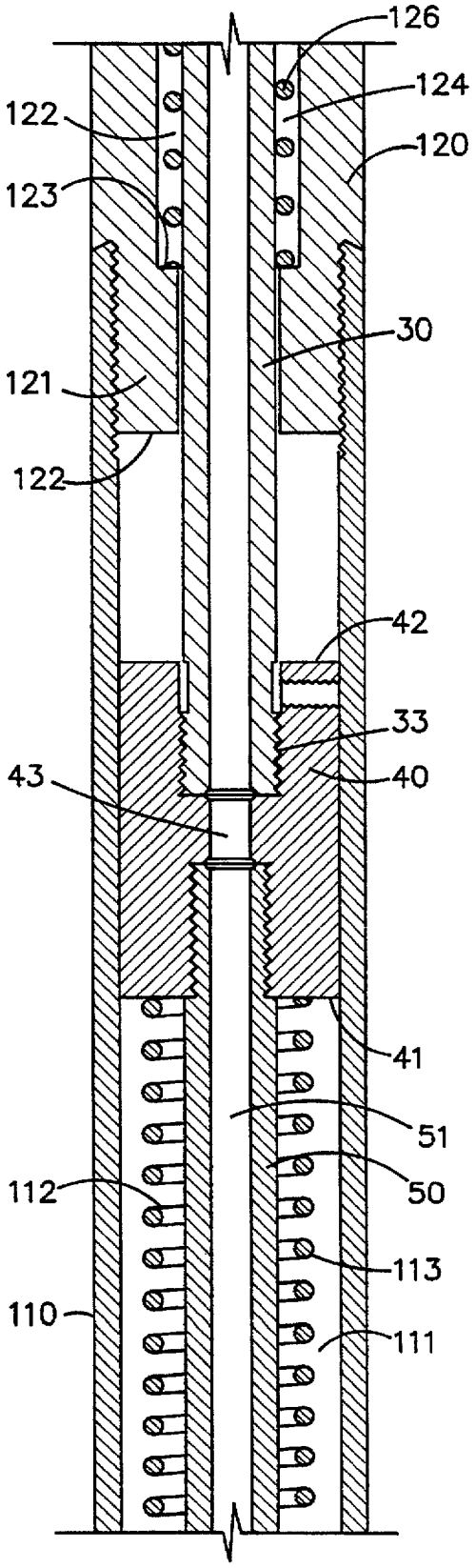
Figure 2D:
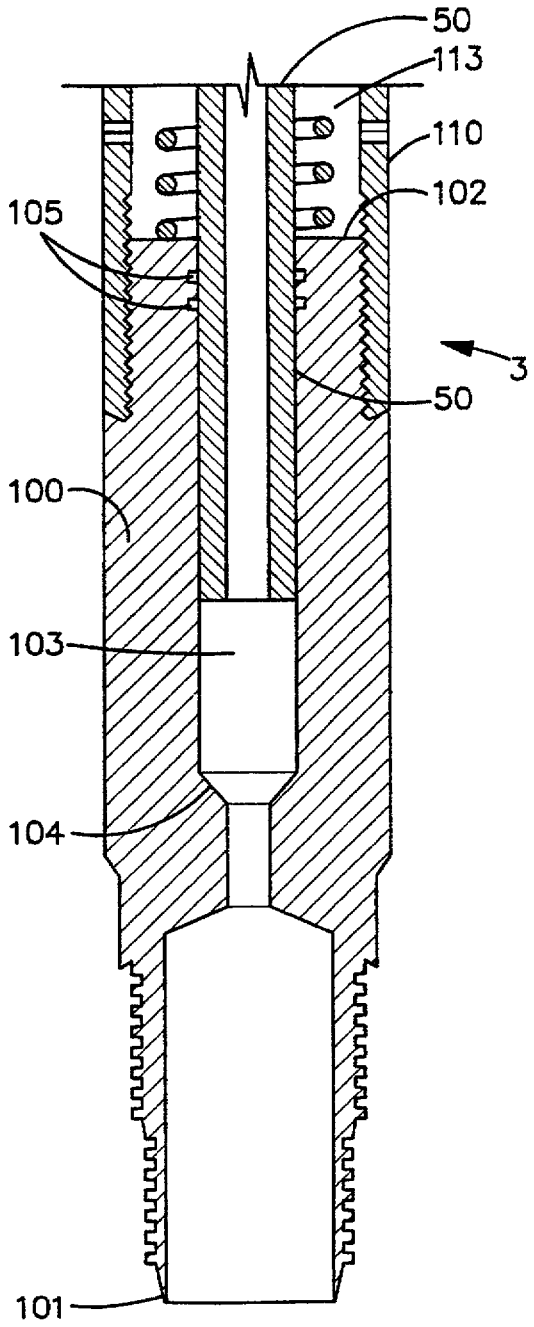

The top of the invention begins at FIG. 1A and 2A. Shown is top assembly 1 consisting of top sub 10, anvil 20, mandril 30, mandril end cap 40 and wash pipe 50. Top sub 10 has two threaded female ends 11 and 12 and axial opening 13 therebetween. End 11 of top sub 10 is for attachment to the working string (not shown)or the fishing string, while end 12 attaches to male end 24 of anvil 20. The other end of anvil 20 forms an anvil shoulder area 26 terminating in cam engagement shoulder 22. Anvil 20 has an axial opening 25 therethrough aligned with top sub axial opening 13. Positioned on anvil 20 above cam engagement shoulder 22 are two facing shoulders, slip shoulder 22 and contact shoulder 23.

Mandril 30 is threadably attached to anvil 20. Mandril 30 has an axial opening 31 therethrough aligned with anvil axial opening 25. Mandril 30 is also threadably attached to mandril end cap 40 at threads 33. Mandril end cap 40 terminates at one end in spring shoulder 41 and at the other end in butt shoulder 42. Mandril end cap 40 has an axial opening 43 therethrough aligned with mandril axial opening 31.

Wash pipe 50 is threadably attached to mandril end cap 40. Wash pipe 50 also has an axial opening 51 therethrough aligned with mandril end cap axial opening 43. The components of top assembly 1, top sub 10, anvil 20, mandril 30, mandril end cap 40 and wash pipe 50, move as a unit as they are fixedly attached to each other.

Shown in FIG. 1A through 1D and FIG. 2A through 2D is bottom assembly 2 consisting of bottom sub 100, lower body 110, cam spring housing 120, cam housing 130, and collapsible cone 140. As will be shown, the components of bottom assembly 2 move as a unit as they are fixedly attached to each other. Bottom sub 100 has end 101 for attachment to the fishing string or to well string (not shown). The other end of bottom sub 100 terminates in main spring shoulder 102. Bottom sub 100 has an axial opening 103 therethrough, sized near main spring shoulder 102 to enable wash pipe 50 to slide therein. Bottom sub axial opening 103 narrows at shoulder 104. Disposed within bottom sub axial opening 103 are a series of sealing means, such as o-rings 105.

Lower body 110 is threadably attached to bottom sub 100. Lower body 110 has an axial opening 111 therethrough, in which mandril end cap 40 is slidably positioned. Lower body 110, main spring shoulder 102 and spring shoulder 41 of mandril end cap 40 define a main spring chamber 112 wherein a biasing means is positioned, such as bellville washers, stacked chevron washers, risked washer springs, or other means, such as that shown, main spring 113. Wash pipe 50 passes through center of main spring 113.

Cam spring housing 120 is threadably attached at bottom end 121 to lower body 110. The top end 125 of cam spring housing 120 is threadably attached to cam housing 130. Cam spring housing 120 has an axial opening 124 therethrough, which opening 124 narrows at bottom end 121. Bottom end 121 of cam spring housing 120 forms an outwardly facing cap shoulder 122 and an inwardly facing cam spring shoulder 123. Top end 125 of cam spring housing 120 defines a bottom cam shoulder 127. Positioned between bottom cam shoulder 127 and cam spring shoulder 123 is an upward facing shoulder, cam activator stop 128. Cap shoulder 122 acts as a stop for upward movement of mandril end cap 41). Mandril 30 is slidable in that portion of cam spring axial opening 124 through bottom end 121. Cam spring housing 120 and cam spring shoulder 123 define a cam spring chamber 129 wherein a biasing means is positioned, such as bellville washers, stacked chevron washers, dished washer springs, or other means such as that shown, cam spring 126. A portion of mandril 30 passes through center of cam spring 126.

Cam housing 130 is threadably attached to cam spring housing 120 and collapsible cone 140. Cam housing 130 has an axial opening 131 therethrough through which a portion of mandril 30 extends.

Collapsible cone 140 has a bottom end 141 and a top end 142. Collapsible cone top end 142 is upwardly flared, while collapsible cone bottom end 141 is threadably attached to the cam housing 130, and defines a top cam shoulder 143. Collapsible cone 140 has an axial opening 144 therethrough having a portion of mandril 30 positioned therein and a portion of anvil 20 positioned therein. In particular, anvil shoulder portion 26 is positioned and slidable in collapsible cone axial opening 144. Collapsible cone top end 142 is adapted to be axially expandable. Collapsible cone top end 142 terminates in an inward facing slip ring shoulder 145. Between collapsible cone top end 142 and bottom end 141 is at least one slot 146 through the sidewalls of collapsible cone 140. Two of such slots are shown in each of FIGS. 1B and 2B. Slots 146 are sized to accommodate slidable bolts 320 as will be later described.

Figure 4:
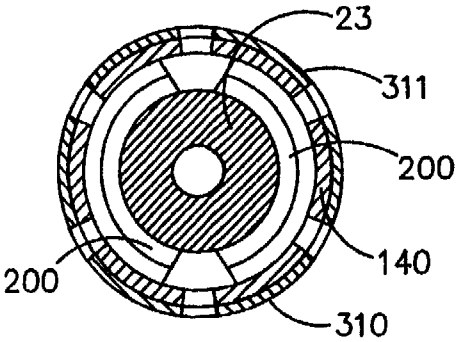
FIG. 4 is an axial cross sectional view of the present invention at line 4—4 of FIG. 2A.

Positioned and slidable in collapsible cone axial opening 144 at collapsible cone top end 142 is as slip ring 200, which may be a split ring as indicated in FIG. 4. Slip ring 200 surrounds and is slidable on the portion of anvil 20 which extends into collapsible cone axial opening 144. Slip ring 200 has a top end shoulder 201 having an angled surface adapted to mate with slip ring shoulder 145 on collapsible cone 140.

Interposed between top assembly 1 and bottom assembly 2 is middle assembly 3 comprising cam activator 300 and slip 310. Slip 310 is slidably positioned on the exterior surface of collapsible cone 140. Slip 310 has a top end 311 adapted to be axially expandable, and a bottom end 312. Slip top end 311 has positioned thereon a slippage means adapted for griping the casing of a well bore to hinder downward movement of invention in that well bore. As shown, one embodiment of the slippage mean is a surface having disposed thereon a series of downward facing wickered or serrated edges 303. Other means for gripping the casing to resist downward movement will be apparent to those skilled in the art.

The second component of middle assembly 3 is cam activator 300. Cam activator 300 is a sleeve slidably surrounding a portion of mandril 30 positioned within the axial opening defined by collapsible cone axial opening 144, cam housing axial opening 131 and cam spring housing axial opening 124. Cam activator has a top end defining a cam activator shoulder 308. Cam activator 300 has a bottom end 301 defining a flange section 302 slidable in cam spring housing 120. Flange section has a bottom face 303 and a top face 304. Cam spring 126 bears upon flange section bottom face 303. Fixedly positioned on the cam activator 300 is cam pin 305. Cam pin 305 is adapted to ride in a cam pin guide 401 on cam 400 as will be later described.

Cam activator 300 and slip 310 are fixed together by an attachment means. As shown, one embodiment of attachment means includes: (1) recessed bolt opening 313 through slip 310, bolt opening 313 alignable with slot 146 in collapsible cone 140; (2) threaded opening 306 in cam activator 300 sized to receive a bolt; and (3) bolt 320 threaded into threaded opening 306 through recessed bolt opening 313. As recessed bolt opening 313 aligns with slot 146 in collapsible cone 140, middle assembly 3 is slidable about top assembly 1, with relative movement between middle assembly 3 and top assembly 1 limited by the length of slot 146. The embodiment shown in FIG. 1B and 2B incorporates two slots and two attachment means.

As indicated, cam activator 300 is also slidable about mandril 30 and as such, middle assembly 3 is slidable about bottom assembly 2.

The final component of the shown embodiment of the invention is cam 400. Cam 400 is a sleeve having a top 407 and a bottom 408 with a cam top flange 409 positioned therebetween on interior surface of cam 400. Between cam top flange 409 and cam bottom 408 is positioned cam pin guide 401 (shown in FIG. 5A and 5B), a channel cut into the inward facing surface of cam 400, positioned therebetween. Cam 400 is rotatably positioned within cam housing axial opening 131 exterior to the cam activator 300 positioned therein. Cam 400 position is vertically fixed relative to cam activator housing 130 as cam top flange 409 abuts top cam shoulder 143 while cam bottom 408 abuts bottom cam shoulder 127.

Figure 5A:
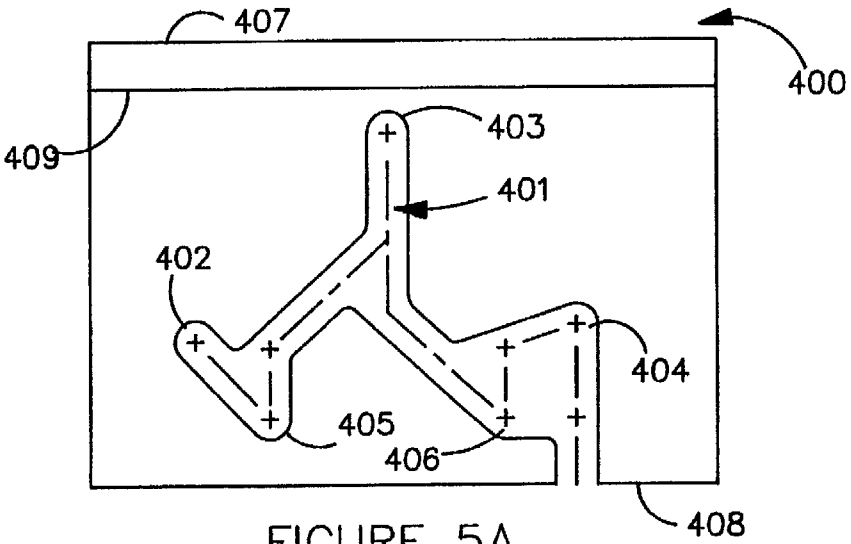
FIG. 5A is a circumferential view of the interior surface of one embodiment of the cam body.
Figure 5B:
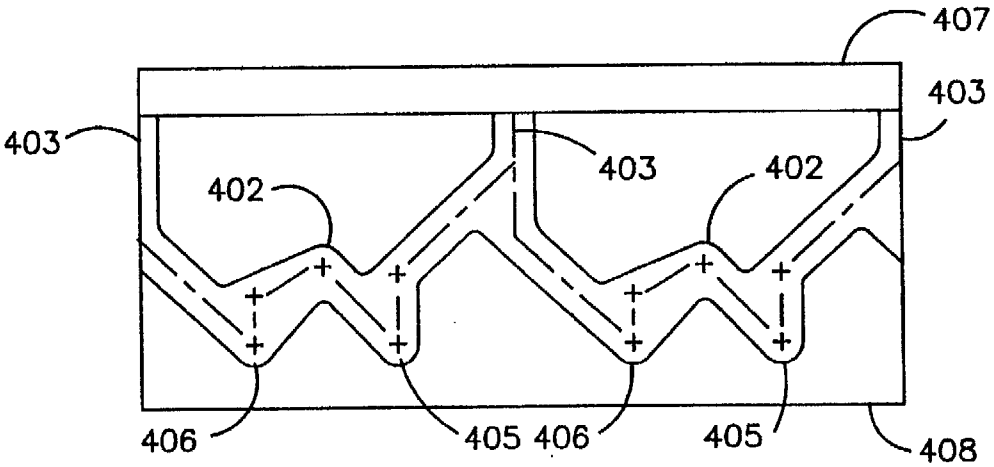
FIG. 5B is a circumferential view of the interior surface of another embodiment of the cam body.

FIG. 5A and 5B show two embodiments of cam pin guide 401. In FIG. 5A, cam pin guide 400 has three set positions: release 402; caught 403; and locked 404; and two intermediary positions, 405 and 406. In FIG. 5B, cam pin guide 401 has a series of two set positions release 402 and caught 403, and a series of intermediary positions 405 and 406. The path of the cam pin 305 in cam pin guide 401 is indicated by dashed lines in both FIGS. 5A and 5B. In operation, the cam pin 305 should be initially in released position 402. In this position, as shown in FIG. 2A, slip 310 is below the widest section of collapsible cone 140, and thus slip 140 is not radially expanded. In the released position, accumulator is slidable upwardly and downwardly in a wellbore. When a compressive load is place upon the accumulator, such as by firing a down jar located above accumulator or by dropping the working string down on the accumulator, the accumulator compresses as follows: top assembly 1 moves downward, slidable in middle assembly 3 and bottom assembly 2. As top assembly 1 moves downward, main spring 113 begins to compress. Continued downward movement of top assembly 1 brings cam engagement shoulder 22 of anvil 20 into contact with cam activator shoulder 308, coupling middle assembly 3 and top assembly 1 for further downward movement. As middle assembly 3 moves downward, cam activator 300 moves downward compressing cam spring 126. Cam pin 305 on cam activator 300 also moves downward. Downward movement of cam pin 305 results in rotation of cam 400, as cam pin 305 rides in cam pin guide 401, but cam 400 cannot move downward, being fixed in position with respect to bottom assembly 2. Cam 400 rotation brings cam pin 305 to intermediary position 405 in cam guide 401. Once cam pin 305 rests in intermediary position 405, further downward movement of cam activator 300 results in a coupling of middle assembly 3 with bottom assembly 2 as cam 400 cannot further rotate in response to additional downward movement of cam pin 305. To prevent cam pin 305 from being sheared off by further downward movement, when cam pin 305 rests in intermediary position 405, bottom face 303 of flanged section 302 of cam activator 300 abuts cam activator stop 128 of cam spring housing 120. Once cam pin 305 reaches intermediary position 405, top assembly 1, middle assembly 3, and bottom assembly 2 are coupled and move as a rigid rod for downward movement.

Figure 3:
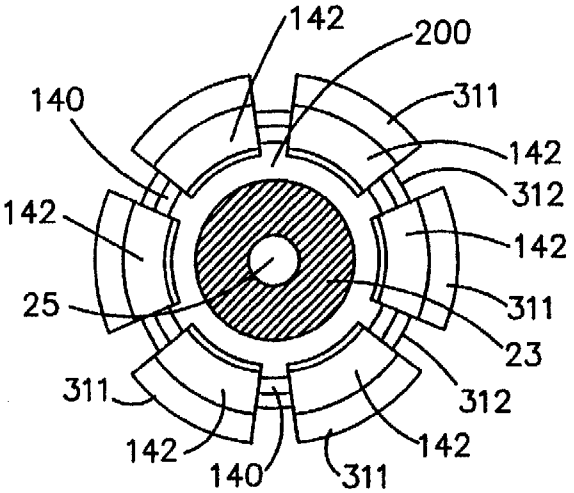
FIG. 3 is an axial cross sectional view of the present invention at line 3—3 of FIG. 1A.

When the downward force is expended and downward movement ceases, as by pulling up on workstring or by dissipation of down jar energy, main spring 113 and cam spring 126 begin to expand. As cam spring 126 expands, cam activator 300 moves up. Cam pin 305 riding in cam pin guide 401 also moves up, forcing cam 400 to rotate placing cam pin 305 at caught position 403 in cam pin guide 401. As cam activator 300 moves up, slip 310 also moves up over collapsible cone 140. Slip 310 is thus expanded radially, coming in contact with casing in wellbore. FIG. 3 shows a cross-section of the accumulator through the slip 310 when the accumulator is in the caught position. The radial expansion of slip 310 is assisted by expansion of main spring 113. As main spring 113 expands, top assembly 1 moves upward forcing slip ring 200 upward until slip ring 200 abuts collapsible cone 140, forcing collapsible cone 140 to expand radially.

Consequently, when cam pin 305 is positioned at caught position 403 of cam pin guide 401, slip 310 bears against casing of well bore; accumulator thus resists downward movement, while being able to move upward with only slight resistance. Consequently, the position of the accumulator, when caught, is fixed respect to the wellbore. Upward movement is possible as serrated edges 311 of slip 310 faces downward, and as top assembly 1 moves upward, cam 400 also moves upward (as top assembly 1 and bottom assembly 2 are now coupled for upward movement by abutment of anvil 20 with slip ring 200 which abuts collapsible cone 140), and as cam 400 moves upward, cam pin 305 will move slightly downward from catch position 403 allowing slip 310 to slide slightly downwardly with respect to collapsible cone 140. Free downward movement of cam pin 305 is resisted by cam spring 126. Consequently, in response to upward movement of top assembly 1, slip 310 will slid down collapsible cone 140 until frictional forces of serrated edges 311 against well bore casing are balanced by upward biasing force of cam spring 126.

To release the accumulator, a downward force is applied to accumulator, such as by use of a down jar, or by setting well string down on caught accumulator, and such downward movement will repeat the actions which initially locked accumulator, except cam pin 305 now moves downward from locked position 403 to intermediary position 406, and, upon release of downward pressure, cam pin 305 moves upward in rotating cam 400 to come to rest in locked position 404. In this position, slip 310 is again below the widest section of collapsible cone 140, and thus slip 310 is not radially expanded. FIG. 4 shows a cross-section of the accumulator through the slip 310 when the accumulator is in the released or locked position. In the locked position, accumulator may be moved upwardly or downwardly, and compression of accumulator will not reset accumulator into caught position 403; the accumulator is locked in a released position.

By utilizing the cam disclosed in FIG. 5B, accumulator can be reset into released position 402, as cam 400 has no locked position because each caught position 403 leads to a released position 402 and vice versa.

In an alternative embodiment of the present invention, top assembly 1 terminates in anvil 20 (that is, top assembly 1 lacks mandril 30, mandrill end cap 40 and wash pipe 50) while bottom assembly 2 lacks lower body 110 and main spring 113.

Other embodiments of the cam 400 are possible; in fact, any cam having at least two positions and setable by a downward movement will be suitable, for instance the embodiment of ratcheting camming mechanism disclosed in U.S. Pat. No. 5,085,479 and shown in FIG. 3 of that patent, incorporated herein by reference. While not preferred, cams setable by hydraulic action, instead of mechanical action, can also be employed.

Further, the relative positions of the cam pin 305 and cam 400 can be reversed. That is, cam pin 305 can be fixed to the interior of a rotatable sleeve, while cam 400 can be fixed to cam activator 300. Other embodiments of the cam 400 will be apparent to those skilled in the arts.

Figure 6:
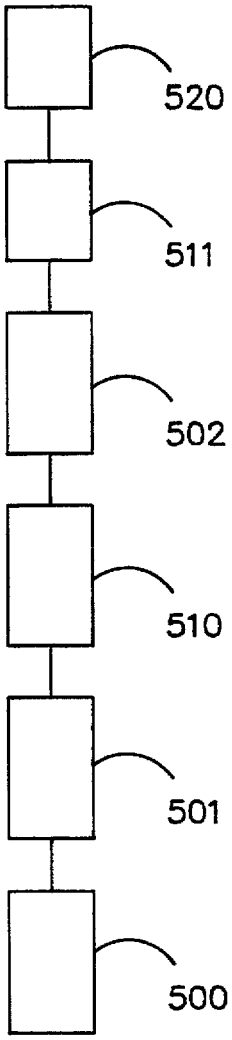
FIG. 6 is a schematic depiction of an appropriate fishing string which incorporates the downhole energy accumulator of invention.

The accumulator can be used in a variety of fishing string configurations. Shown in FIGS. 6–7are several such configurations. In FIG. 6 is shown stuck fish 600, fishing tool 501, accumulator 502, two sections of work string 510 and 511, and a hoisting rig 520. The configuration shown in FIG. 6 is useful for pulling on a vacuum, friction or sand stuck fish 500. In this configuration, the fish 500 is attached to the fishing tool 501, and the work string is pulled by the hoisting rig 520 until the load on the pipe reaches a desired setting. At this time, the accumulator 502 is set in the caught configuration, fixing the position of the fishing string with respect to the cased portion of the wellbore. Once caught, tension on pipe string 510 above accumulator 502 can be released by hoisting rig 520. Tension on pipe string 511 below accumulator 502 remains in place. The fishing string is then allowed to remain in this configuration until liquid begins to seep below stuck fish 500, breaking the vacuum holding fish 500, and thus freeing fish 500. In some applications, such as stuck threaded pipe, fishing tool 501 is simply a section of pipe for mating with stuck pipe; alternatively, accumulator 502 could be attached directly to stuck fish 500 without the need for a fishing tool.

Figure 7:
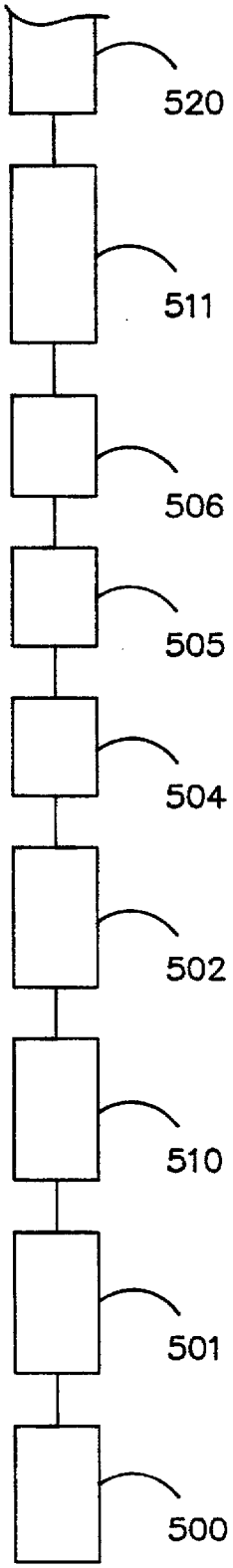
FIG. 7 is a depiction of another appropriate fishing string which incorporates the downhole energy accumulator of invention.

The accumulator 502 may also be used in a fishing string employing jars and accelerators, as is shown in FIG. 7. FIG. 7 shows stuck fish 500, fishing tool 501, pipe string 510, accumulator 502, jar 504, weight means, such as drill collars 505, accelerator 506, pipe string 511, and hoisting rig 520. In this configuration, pipe string 510 is of sufficient length to allow accumulator 502 to be adjacent to a cased section of wellbore. At this point, fishing tool 501 attaches to fish 500, accumulator 502 is set in the caught position, the entire string is moved upward by hoisting rig 520 to remove pipe slack. The accumulator 502 is then set in the caught position, fixing the position of the fishing string with respect to the wellbore. The jar 504, accelerator 506, and drill collars 505 are then allowed to operated in the conventional manner to impart a series of upward jarring forces to the stuck fish 500. Thereby moving the fixed position of the fishing string upwardly with respect to the wellbore, but accumulator 502 resisting downward movement of the fishing string. The use of accelerator 506 and drill collars 505 is optional, but preferred. Jar 504 can be an up jar, a two-way jar (both up and down) or a combined jar and accelerator.

There are, of course, other embodiments which are obvious from the foregoing descriptions of the invention which are intended to be included within the scope of the invention defined by the following claims.

I claim:

1. An accumulator insertable into a well fishing string for delivering upward forces to stuck objects in a well having a cased portion, comprising a housing having a top and a bottom and an exterior surface, said exterior surface facing said wellbore, said top and said bottom having means for attaching to said fishing string, a slippage means operatively positioned on said exterior of said housing, said slippage means adapted for engaging said cased portion of said well so that when so engaged said accumulator is supportively connected to said cased portion against downward movement, and an activator means operatively connected to said slippage means for engaging said slippage means against said cased portion of said wellbore, said slippage means and said activator means cooperating so that when said slippage means is engaged, said accumulator is supportively connected to said cased portion against downward movement but said slippage means can move upwardly in said well in response to an upward force exerted on said fishing string.

2. An accumulator according to claim 1 further comprising a retraction means operatively connected to said slippage means for disengaging said slippage means from said cased portion of said well bore, thereby allowing downward movement of said accumulator.

3. An accumulator according to claim 1 wherein said activator means comprises a cam.

4. An accumulator according to claim 2 wherein said retraction means comprises a cam.

5. An accumulator according to claim 1 wherein said slippage means comprises a slip having outwardly facing serrated edges.

6. An accumulator according to claim 5 wherein said housing includes a cone shaped portion, said slip slidable on the exterior of said cone shaped portion.

7. An accumulator according to claim 6 wherein said cone shaped portion is collapsible.

8. An accumulator according to claim 1 wherein said housing includes a cone shaped portion, said accumulator further includes a slip ring and an anvil, said anvil slidable in the interior of said housing, said slip ring slidable on said anvil, said slip ring and said anvil cooperating to expand radially said cone shaped portion of said housing in response to an upward movement of said anvil.

9. A method of fleeing a stuck fish in a wellbore having a cased portion, said method comprising the steps of lowering a fishing string in said wellbore, attaching said fishing string to said stuck fish, attaching said fishing string at a fixed position relative to said cased portion so as to restrict the downward movement of said fishing string located at and below said fixed position but allowing upward movement of said fixed position relative to said cased portion in response to upward forces exerted on said fishing string, and applying a series of upward forces to said fishing string to move said fixed position upwardly.

10. A method of freeing a stuck fish according to claim 9 wherein said upward forces are jarring forces.

11. A method of freeing a stuck fish according to claim 9 wherein said step of applying a series of upward forces is accomplished by use of jars.

12. A method of freeing a stuck fish according to claim 9 wherein said step of applying a series of upward forces is accomplished by use of jars and accelerators.

13. An accumulator insertable into a well fishing string for delivering upward forces to stuck objects in a well having a cased portion, comprising a housing having a top and a bottom and an exterior surface, said exterior surface facing said wellbore, said top and said bottom having means for attaching to said fishing string, a slippage means operatively positioned on said exterior of said housing, said slippage means adapted for engaging said cased portion of said well so that when so engaged said accumulator is supportively connected to said cased portion against downward movement, and an activator operatively connected to said slippage means for engaging said slippage means against said cased portion of said wellbore, said slippage means and said activator cooperating so that when said slippage means is engaged, said accumulator is supportively connected to said cased portion against downward movement but said slippage means can move upwardly in said well in response to an upward force, said activator comprising:

(i) a cam positioned on said housing and rotatable on said housing;

(ii) said slippage means being slidably engagable with said cam along a guide, said guide having a first release position and a first caught position;

(iii) said first caught position further having a downward lateral extent such that when said slippage means is engaged at said first caught position, said slippage means engagement, in response to an upward force, sliding downwardly in said guide at said first caught position;

(iv) said slippage means being radially expandable when engaged with said cam at said first caught position;

(v) a cam spring positioned on said housing and adapted to bias said slippage means upwardly;

(vi) said cam and said slippage means cooperating to rotate said cam in response to a sufficient downward force on said slippage means when said slippage means is engaged at said cam at said first release position, said rotation causing said slippage means to become engaged with said guide at said first caught position.

14. An accumulator according to claim 13 further having a retraction member operatively connected to said slippage means for disengaging said slippage means from said cased portion of said wellbore, thereby allowing downward movement of said accumulator, said retraction member comprising a second release position on said guide, and said cam, when said slippage means is engaged with said cam at said first caught position, rotating in response to a sufficient downward force exerted on said slippage means, said rotation causing said slippage means to become engaged with said guide at said second release position.

15. An accumulator according to claim 13 wherein said housing farther has an opening therethrough, said accumulator further having a cam activator disposed in said interior of said housing, said cam activator fixedly attached to said slippage means by attachment means disposed through said opening in said housing, said cam activator being slidably engagable with said cam along said guide.

* * * * *